US005542446A

United States Patent [19]

Rose

[11] Patent Number: 5,542,446

[45] Date of Patent: Aug. 6, 1996

[54] SCUBA BUOYANCY CONTROL VALVE

[76] Inventor: Richard H. Rose, 2925 Spear Ave., Ardsley, Pa. 19038

[21] Appl. No.: 512,545

[22] Filed: Aug. 8, 1995

[51] Int. Cl.[6] ..... F16K 17/36

[52] U.S. Cl. ..... 137/81.2; 128/202.14; 128/201.28

[58] Field of Search ..... 128/202.14, 201.28; 137/81.2, 625.66, 625.69; 114/333, 331

[56] References Cited

U.S. PATENT DOCUMENTS

| | | | |
|---|---|---|---|
| 1,138,495 | 5/1915 | Macaulay . | |
| 1,792,125 | 2/1931 | Shave . | |
| 3,436,777 | 4/1969 | Greenwood | 405/186 |
| 4,144,607 | 3/1979 | Soubie | 9/339 |
| 4,229,832 | 10/1980 | Dickson, Sr. | 137/81.2 |
| 4,437,843 | 3/1984 | Birle | 128/202.14 |
| 4,674,429 | 6/1987 | Buckle et al. | 137/81.2 |
| 4,694,772 | 9/1987 | Faulconer et al. | 114/315 |
| 4,872,783 | 10/1989 | Greenwood | 405/186 |
| 4,990,115 | 2/1991 | Vorhauer et al. | 441/111 |
| 5,022,879 | 6/1991 | DiForte | 441/113 |
| 5,101,818 | 4/1992 | Chace et al. | 128/202.14 |

*Primary Examiner*—A. Michael Chambers
*Attorney, Agent, or Firm*—Synnestvedt & Lechner

[57] ABSTRACT

A buoyancy control valve assembly for maintaining a diver's neutral buoyancy as the diver descends or ascends by automatically admitting air to or releasing air from the diver's buoyancy compensator. The assembly includes a valve body having a reference air chamber and a piston communicating at one end with the air chamber and at the other end with the water. Annuluses on the piston provide connection of a port leading to the buoyancy compensator either with a source of pressurized air or with a vent port as the diver descends or ascends. At neutral buoyancy, the piston moves to a neutral position, blocking flow through the compensator port. A bleed line with a check valve connects the compensator port with the air chamber, and a vent port in the piston connects the air chamber with the piston vent annulus to permit the appropriate change in the air chamber pressure to allow return of the piston to its neutral position.

8 Claims, 2 Drawing Sheets

SCUBA BUOYANCY CONTROL VALVE

BACKGROUND OF THE INVENTION

The present invention relates generally to scuba diving equipment and relates more particularly to a buoyancy control valve which automatically maintains a neutral buoyancy of a diver operating at various depths by admitting air to or releasing air from a diver's buoyancy compensator.

As a scuba diver descends into deeper water, his body, suit and vest become compressed by the increasing water pressure, and the diver's displacement and hence his buoyancy is decreased. Conversely, upon ascending, the diver's displacement becomes greater as the water pressure decreases, and his buoyancy increases.

In order to neutralize these effects, it is common practice for a scuba diver to wear a buoyancy compensator, usually in the form of a vest having inflatable chambers, which provides a neutral buoyancy of the diver at a given depth. To achieve such neutral buoyancy, it is necessary for the diver to manually add air to the buoyancy compensator or vent air from the compensator. Air may be introduced to the compensator directly from pressurized tanks of breathing air, or less commonly, by means of an auxiliary mouth piece, from the diver's lungs. Examples of buoyancy compensators are shown in U.S. Pat. Nos. 3,436,777, 4,69,772 and 4,872,783.

The need for a manual adjustment of the buoyancy of the compensator for each significant change in diving depth is a bothersome but heretofore necessary diversion which interrupts the continuity of a dive and which can be an unnecessary complication if the diver's hands are involved in the handling of other equipment such as cameras, propulsion devices or spear guns.

SUMMARY OF THE INVENTION

The present invention provides a novel control valve assembly for use with a buoyancy compensator and pressurized air source which will automatically introduce air into or vent air from the buoyancy compensator in response to changes in the diver's depth. The invention includes a valve body having a reference air chamber therewithin and having a bore connecting the chamber with a port open to water pressure. A piston within the bore is positioned in accordance with the water pressure bearing against one end thereof in addition to the force of a spring, and the air pressure in the air chamber acting on the other end of the piston. Spaced ports in the valve body communicate with the bore, the ports connecting the bore with a source of pressurized air, the buoyancy compensator, and the water. A bleed passage and check valve connect the buoyancy compensator port with the air chamber, permitting flow only into the chamber.

The piston includes an air inlet annulus which permits fluid communication between the pressurized air port and the buoyancy compensator port when the water pressure and spring force combine to move the piston against the force of the air pressure toward the reference chamber. A vent annulus of the piston provides communication between the vent port and the buoyancy compensator port when the reference chamber air pressure force moves the piston in the opposition direction against the force of the water pressure and spring. A bleed passage in the piston end permits air to bleed from the air chamber into the vent annulus and vent port until the piston returns to its neutral position. At the neutral piston position, there is no air flow into or out of the buoyancy compensator, the water pressure and spring forces being balanced by the reference chamber air pressure. The piston bleed passage and the air bleed passage and check valve provide an automatic, gradual change of the air chamber reference pressure as necessary to permit proper piston return to a neutral position.

It is accordingly a first object of the present invention to provide a control valve connecting a pressurized air source with a scuba buoyancy compensator which provides continuous and automatic buoyancy compensation for the diver as the diver moves through various depth levels of a dive.

Another object of the invention is to provide a control valve as described which is lightweight, small in size and which can be readily worn on a buoyancy compensator or on a regulator.

A further object of the invention is to provide a control valve as described which can be readily fabricated from materials which are not subject to corrosion from repeated immersion in water, especially salt water, such materials including plastics and particularly those which can be utilized in injection molding processes.

Still another object of the invention is to provide a control valve assembly as described which is relatively simple in design and which can be economically manufactured.

Additional objects and advantages of the invention will be apparent to those skilled in the art upon consideration of the following detailed description of an embodiment of the invention.

DESCRIPTION OF THE PREFERRED EMBODIMENTS

Figure 1:
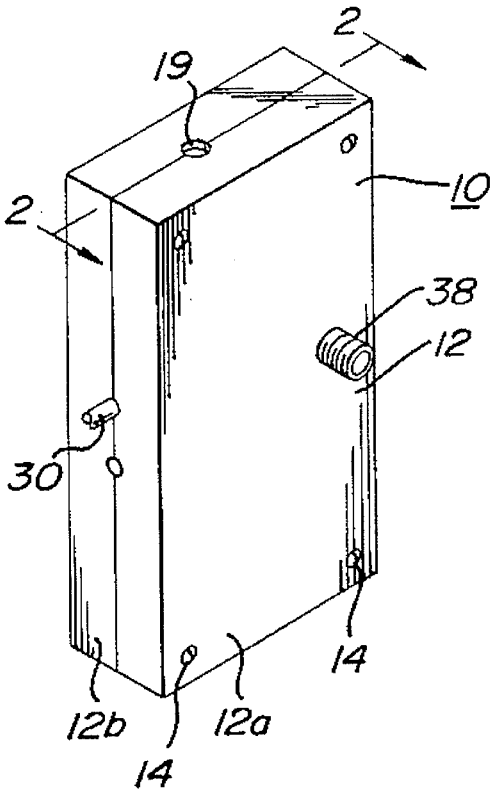
FIG. 1 is an isometric view of a buoyancy control valve assembly in accordance with the present invention.
Figure 2:
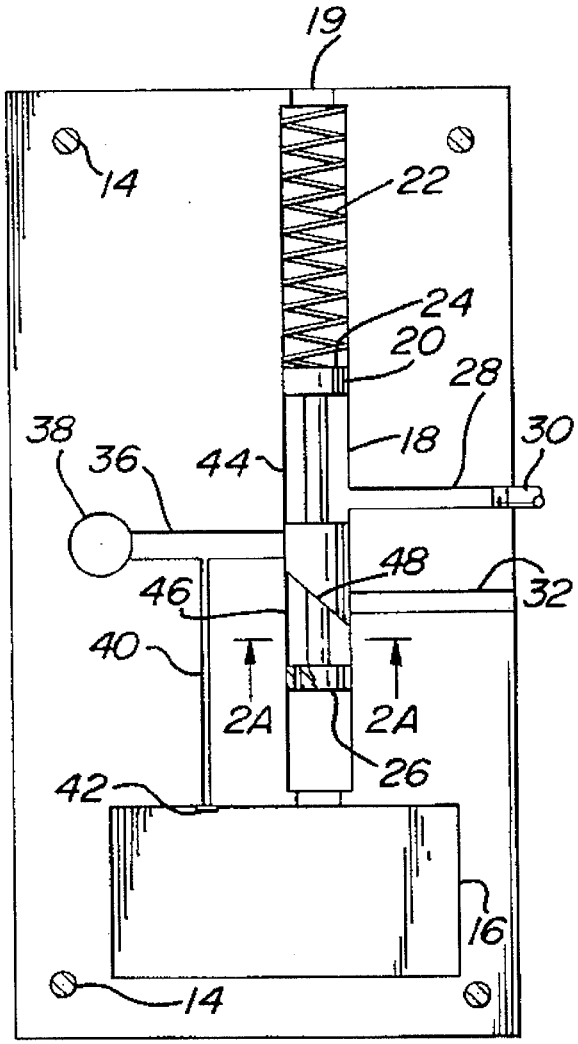
FIG. 2 is an enlarged disassembled view of the valve assembly shown in FIG. 1, the view being taken along line 2—2 of FIG. 1.
Figure 2A:
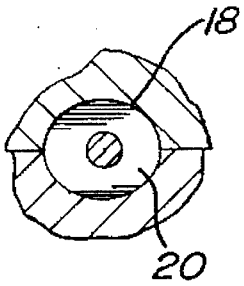
FIG. 2A is an enlarged sectional view taken along line 2A—2A of FIG. 2.

Referring to the drawings and particularly FIGS. 1 and 2 thereof, a buoyancy control valve assembly generally designated 10 in accordance with the present invention is shown including a valve body 12 formed of valve body halves 12*a* and 12*b* which are joined by fasteners 14. Formed within the valve body 12 by means of corresponding cavities in the valve body halves 12*a* and 12*b* is a reference air chamber 16. A bore 18 similarly formed within the valve body intersects the air chamber 16 at one end thereof and opens through the end of the valve body at a port 19 through which water is free to enter into the bore 18. As shown in FIG. 2A, the bore 18 is oval in cross-sectional shape for a reason which will become presently apparent. A piston 20 is slidably disposed within the bore 18, and as shown in FIG. 2A, the piston is also of an oval sectional shape, the piston accordingly being unable to rotate. A compression coil spring 22 is disposed in the bore 18 adjacent the water inlet port 19 and bears against the outer end 24 of the piston, thus serving to augment the force of the water pressure in the bore to bias the piston toward the air chamber 16. The inner end 26 of the piston is exposed to the air pressure in the air chamber 16 and accordingly the piston position is determined by the relative strengths of the air pressure force generated against the piston end 26 and the water pressure and spring forces generated against the opposite outer end 24 of the piston.

A pressurized air inlet port 28 extends from the exterior of the valve body and intersects the bore 18. A conduit 30 joins the port 28 to the source of pressurized air, most conveniently the tank of compressed breathing air carried by the diver. A vent air port 32 is similarly provided to communicate with the bore 18 at a point spaced from the intersection with the port 28. The port 32 at its outer end opens into the water at opening 34.

Compensator port 36 intersects the bore 18 at a point intermediate the bore intersections with ports 28 and 32, the port 36 at its other end terminating at a threaded outlet 38 which connects to the air chambers of the buoyancy compensator. An air bleed line 40 joins the compensator port 36 with the air chamber 16, a check valve 42 being provided to permit air flow through the bleed line only into the air chamber 16.

Figure 3:
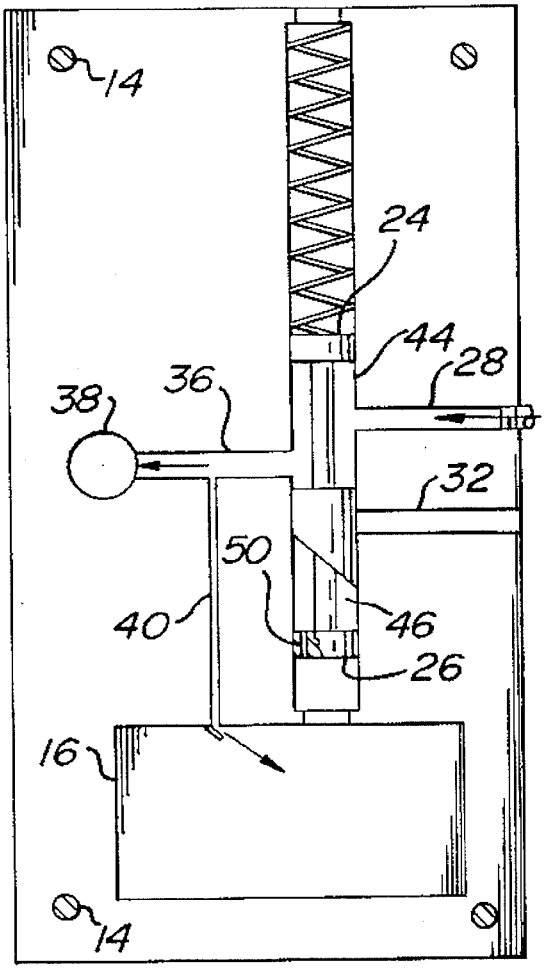
FIG. 3 is a view similar to FIG. 2, but showing the piston in a position permitting entry of pressurized air into the buoyancy compensator.

The piston 20 is provided with a pair of annuluses which permits selective communication of the compensator port 36 with either the inlet port 28 or vent port 32, depending upon the relative pressure conditions of the water and the air chamber 16 and their resultant positioning of the piston within the bore 18. Specifically, the piston includes an inlet annulus 44 adjacent the outer end of the piston which in the balanced condition of the valve assembly shown in FIG. 2 communicates only with the inlet port 28. When the combined forces of the spring 22 and the water pressure acting on the end 24 of the piston move the piston toward the air chamber 16 as shown in FIG. 3, the inlet annulus 44 then permits fluid communication between the inlet port 28 and the compensator port 36 leading and air will accordingly move into the buoyancy compensator until the piston is again moved to the position shown in FIG. 2 blocking the port 36. Said piston movement will result from the flow of air through the bleed line 40 into the air chamber 16, giving rise to an increased air pressure in the chamber and a resultant increased force acting on the end 26 of the piston which moves the piston against the water and spring forces.

Figure 4:
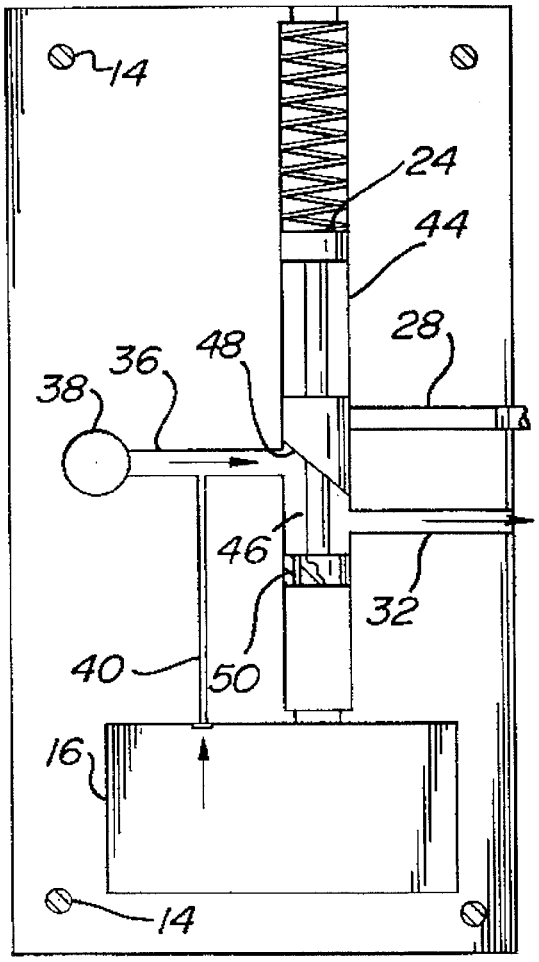
FIG. 4 is a view similar to FIG. 2 showing the piston in a position permitting the venting of air from the buoyancy compensator.

A vent annulus 46 is provided on the piston 20 adjacent the inner end 26 of the piston, the vent annulus 46 having a bevelled face 48 at one end thereof which as shown in FIG. 4 permits communication between the vent port 32 and the compensator port 36 when the piston is moved outwardly as will occur when the force of the air pressure in chamber 16 acting on the piston is greater than the combined forces of the spring and the water pressure acting against the opposite piston end. The piston will return to its balanced position as shown in FIG. 2 when the air pressure in the chamber 16 becomes reduced as air flows through a bleed passage 50 in the inner end of the piston into the vent annulus 46. A portion of the piston 20 is shown in section in FIGS. 2, 3 and 4 for the purpose of clearly illustrating the bleed passage 50.

For operation of the present valve assembly, the assembly is preferably mounted directly on the diver's buoyancy compensator by means of the threaded outlet connector 38. The conduit 30 is connected to the diver's pressurized air source and the device is ready for operation.

After the diver enters the water and while still at the surface, the buoyancy compensator is manually filled by the diver to achieve a neutral buoyancy condition. This manual filling of the compensator is done utilizing a conventional control valve connecting the pressurized air source with the compensator in a well known manner. Once the diver's buoyancy has been neutralized at the surface, the dive may progress and the present device will automatically provide buoyancy compensation as the dive progresses through various water depths.

As the diver descends, the increasing water pressure acting on the piston end 24 in conjunction with the spring 22 will move the piston from its neutral balanced position shown in FIG. 2, toward the air chamber into the position shown in FIG. 3, thereby permitting communication by way of the inlet annulus 44 between the inlet port 28 and the compensator port 36. As air is flowing into the compensator, some air also flows through bleed line 40 and check valve 42 into the air chamber 16, increasing the air chamber pressure and hence the force acting on the opposite end 26 of the piston. The piston will thus gradually return toward and into its neutral position as shown in FIG. 2, thus cutting off flow from the inlet port to the compensator port.

As the driver ascends, the decreasing water pressure acting on the end 24 of the piston permits the piston to move under influence of the pressure in the chamber 16 away from the chamber 16 into the position shown in FIG. 4, thus allowing the vent annulus 46 to permit communication between the compensator port 36 and the vent port 32. As air flows from the compensator, the pressure in the chamber 16 is also reduced by air flow through the bleed passage 50 into the vent annulus 46, thus reducing the reference air pressure in chamber 16 and permitting the piston to gradually move back toward and into the neutral position shown in FIG. 2. The positions shown in FIGS. 3 and 4 are wide open positions of the respective annuluses which would be representative of rather steep descents or ascents respectively. With more gradual changes in dive depth, the piston would not move as far from its neutral position and the inlet or venting of air from the compensator would be more gradual.

From the foregoing it can be understood that the present device provides a continuous and automatic buoyancy compensation for a diver and eliminates the need for a manual input or venting of air from the compensator.

The device can be made of a relatively small size which can be worn on the compensator with no interference with the diver's motions or other equipment. The device is preferably made of a molded plastic material and the splitting of the valve body and the formation of the air chamber, bore and various ports in the valve body halves lends itself to fabrication by injection molding process.

Manifestly, changes in details of construction can be effected by those skilled in the art without departing from the present invention.

What is claimed is:

1. A buoyancy control valve assembly for automatically controlling air flow from a scuba diver's pressurized air tank to a buoyancy compensator to maintain neutral buoyancy at any depth, said valve assembly comprising;

a valve body, an air chamber within said valve body, a bore in said valve body, said bore communicating at one end with said air chamber and at the opposite end with an opening in said valve body, a piston slidably disposed in said bore, the position of said piston being determined by the air pressure from the chamber acting on one end of the piston and water pressure acting on the opposite end of the pistons, an air inlet port communicating with said bore and connectable with a source of pressurized air, a vent port communicating with said bore at a point spaced from air port and communicating with an opening in said valve body, a compensator port communicating with said bore at one end and connectable to a buoyancy compensator at its other end, said piston in a neutral position blocking said compensator port from communication with either said air inlet port or said vent port, said piston including passage means permitting communication of said compensator port with said air inlet port when the water pressure on said piston moves the piston against the air pressure force from the neutral position toward the air chamber, passage means in said piston permitting communication of said compensator port with said vent port when the air pressure force moves the piston from the neutral position away from the air chamber, and bleed means for gradually changing the pressure in said air chamber when said piston has been moved from its neutral position in order to permit return of the piston to its neutral position.

2. The invention as claimed in claim 1, wherein said bleed means includes a bleed passage connecting said compensator port with said air chamber and including a check valve permitting flow only into said air chamber.

3. The invention as claimed in claim 1, wherein said bleed means includes a bleed passage in the piston permitting communication between said air chamber and said piston passage communicating with said vent port.

4. The invention as claimed in claim 1, including a compression spring acting on said piston in conjunction with the water pressure force to urge said piston toward said air chamber.

5. The invention as claimed in claim 1, wherein said passages in said piston include an inlet annulus permitting communication between said compensator port and said inlet port in a first position of said piston, and a vent annulus permitting communication between said compensator port and said vent port in a second position of said piston.

6. The invention as claimed in claim 1, wherein said valve body is formed of two valve body halves, said air chamber, bore and said ports being formed in part in each valve body half, and means for securing said valve body halves in sealing relation following the assembly of said piston.

7. The invention as claimed in claim 6, wherein said valve assembly is formed of a molded plastic material.

8. The invention as claimed in claim 6, wherein said bore and said piston are non-circular in shape to prevent rotation of the piston.

* * * * *